United States Patent [19]

Flick

[11] 4,166,330

[45] Sep. 4, 1979

[54] HAND SNOW PLOW

[76] Inventor: Kenneth R. Flick, 1533 E. 20th St., Erie, Pa. 16510

[21] Appl. No.: 883,586

[22] Filed: Mar. 6, 1978

[51] Int. Cl.[2] ..... E01H 5/02

[52] U.S. Cl. ..... 37/53; 37/130; 294/56; 294/54

[58] Field of Search ..... 37/130, 131, 53; 294/54–58

[56] References Cited

U.S. PATENT DOCUMENTS

| | | | |
|---|---|---|---|
| 583,484 | 6/1897 | Kenaga | 37/130 |
| 3,028,695 | 4/1962 | Westby | 37/130 |
| 3,037,308 | 6/1962 | Miller | 37/130 |
| 4,048,735 | 9/1977 | Brunty | 37/53 |

FOREIGN PATENT DOCUMENTS

| | | | |
|---|---|---|---|
| 681680 | 3/1964 | Canada | 37/53 |

*Primary Examiner*—E. H. Eickholt

*Attorney, Agent, or Firm*—Ralph Hammar

[57] ABSTRACT

A pusher type hand snow plow in which the lower edge of the blade is supported by runners and the supporting frame for the blade has a raised center to which side frames incline upwardly and rearwardly from the lower edge of the blade. The raised center prevents jamming in deep snow.

4 Claims, 3 Drawing Figures

HAND SNOW PLOW

This invention is a snow plow with a raised center frame which does not clog or jam with snow.

Figure 2:
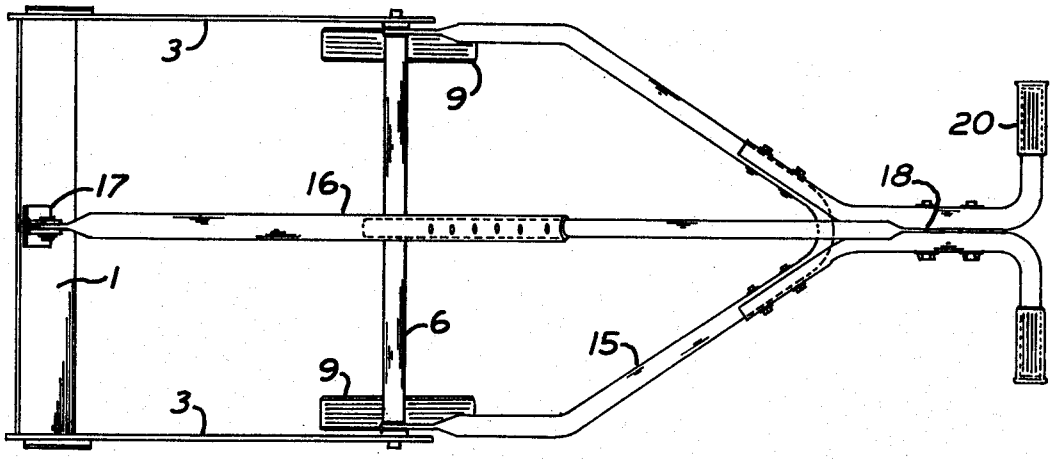
FIG. 2 is a top plan view.
Figure 1:
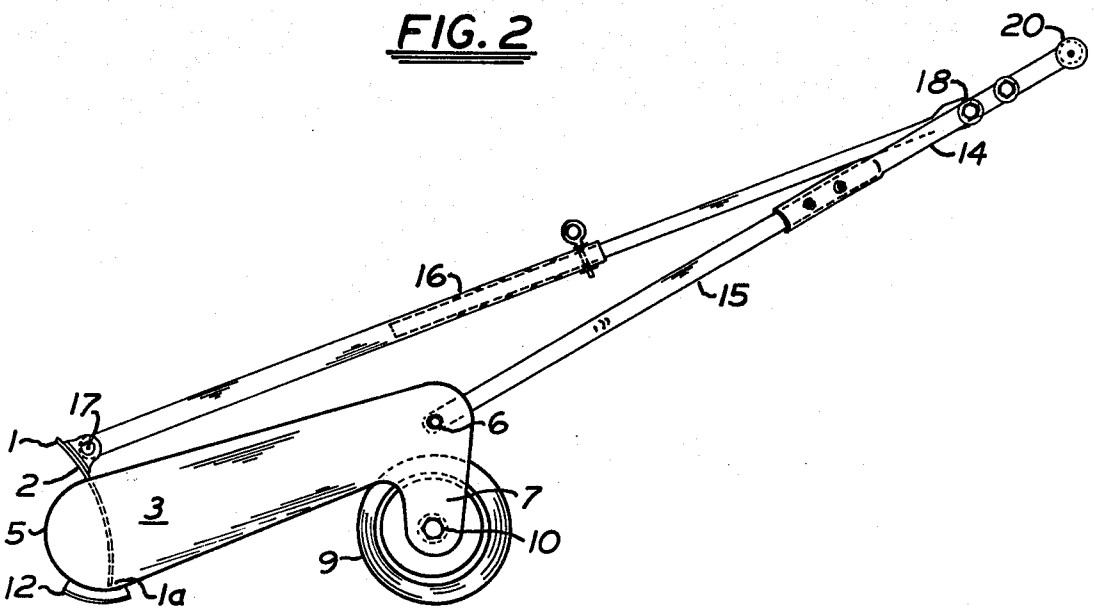
FIG. 1 is a side elevation of the plow.
Figure 3:
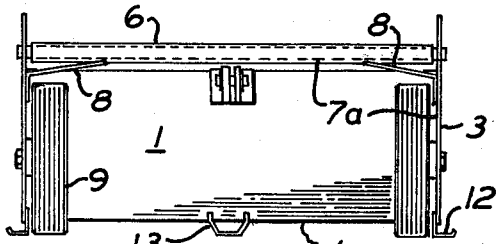
FIG. 3 is a rear elevation of the plow.

The blade 1 extends substantially at right angles to the direction of plowing and has a dished front face 2. The blade is supported by two side plates 3 respectively fixed to opposite ends of the blade. The front end 5 of each side plate projects beyond the front face 2 of the blade so as to block the flow of snow off the ends of the blade. The rear ends of the side plates are fixed to opposite ends of the top or cross member 6 which together with the extensions 7 of the side frames 3 forms an inverted U frame 7*a*. The connection between the side plates 3 and the blade and cross member 6 are rigid and suitable corner braces 8 may be provided where needed. The frame 7*a* is supported by wheels 9 journaled on stub shafts 10 on the lower ends of the extensions 7 of the side frames 3. At the front, the frame is supported by runners 12 on the lower front edges of the side plates 3 and also by a center runner 13 fixed to the center of the blade. The purpose of the runners 12 and 13 is to stop the lower edge 1*a* of the blade a fixed distance above the surface being plowed, for example $\frac{3}{8}$–$\frac{3}{4}$ of an inch.

The plow is pushed by a handle 14 having forks 15 pivoted on the cross member 6 and having an adjustable length telescoping strut 16 extending between a hinge pin 17 at the top center of the blade and a hinge pin 18 at the rear of the handle. The length of the strut 16 determines the angle of inclination of the handle 14. Once adjusted, the strut remains at the adjusted length.

The cross member 6 and associated side members 11 provide a frame in which the entire center is raised. In the particular plow shown, the wheels are 8 inches in diameter, the blade is 12 inches high, the cross member 6 is 10 inches above ground and 23 inches behind the blade. For normal plowing, the hand grips 20 would be at about waist level. Lowering the hand grips would lift the lower edge of the blade so the blade would skim the top layer off very deep snow. The open space beneath the cross member facilitates this procedure. The rearward and upward inclination of the lower edges of the side plates 3 provides a relief which prevents clogging and minimizes the drag forces from the snow.

In addition to pushing, the blade can be used for pulling snow away from fences, etc. For pulling, the blade is lifted by lowering the hand grips 20 and then dropped in front of the snow to be pulled back. The open space between the side plates 3 and below the cross member 6 provides room for the snow.

I claim:

1. A hand snow plow comprising an inverted U shaped frame, a pair of stub axles respectively on one and the other of the lower ends of the sides of the U, a pair of wheels respectively on one and the other of said axles, a handle fixed to and extending rearward from the top of the U, side plates extending forward in continuation of the sides of the U, a blade extending between and having opposite ends fixed to the forward ends of said side plates, the forward ends of the side plates extending in front of the blade to block the flow of snow over the side edges of the blade, runners on the forward ends of the side plates for supporting the blade above the surface from which snow is to be plowed, and a strut having one end fixed to the blade and the other end fixed to the handle.

2. The plow of claim 1 in which the front ends of the side plates extend in front of the blade to block the flow of snow over the side edges of the blade.

3. The plow of claim 1 in which the lower edges of said side plates incline upwardly and rearwardly from the blade to said U.

4. The plow of claim 1 in which the handle has a fork pivoted to the top of the U and a strut extending from the handle to the center of the blade.

* * * * *